US006414243B1

(12) United States Patent
Korinek et al.

(10) Patent No.: US 6,414,243 B1
(45) Date of Patent: Jul. 2, 2002

(54) TWIST-ON WIRE CONNECTOR ADAPTED FOR RAPID ASSEMBLY

(75) Inventors: Chris W. Korinek, Cedarburg; Nicholas J. Jasunas, Milwaukee, both of WI (US)

(73) Assignee: Actuant Corporation, Milwaukee, WI (US)

( * ) Notice: Subject to any disclaimer, the term of this patent is extended or adjusted under 35 U.S.C. 154(b) by 0 days.

(21) Appl. No.: 08/884,049

(22) Filed: Jun. 26, 1997

(51) Int. Cl.[7] ..... H01R 4/22
(52) U.S. Cl. ..... 174/87; D13/150
(58) Field of Search ..... 174/87; 403/214, 403/268, 396; 206/219, 221; D13/150; D26/10

(56) References Cited

U.S. PATENT DOCUMENTS

| | | | | |
|---|---|---|---|---|
| 3,083,260 A | | 3/1963 | Bird | 174/87 |
| 3,097,257 A | | 7/1963 | Cheney | 174/87 |
| 3,875,324 A | | 4/1975 | Waddington et al. | 174/87 |
| 4,220,811 A | * | 9/1980 | Scott | 174/87 |
| 4,227,040 A | | 10/1980 | Scott | 174/87 |
| 4,288,657 A | * | 9/1981 | Swanson | 174/87 |
| 4,451,695 A | | 5/1984 | Fink | 174/87 |
| 4,924,035 A | | 5/1990 | Miller et al. | 174/87 |
| 5,001,301 A | | 3/1991 | Mar et al. | 174/87 |
| 5,559,307 A | * | 9/1996 | Whitehead et al. | 174/87 |

* cited by examiner

*Primary Examiner*—Chau N. Nguyen
(74) *Attorney, Agent, or Firm*—George E. Haas; Quarles & Brady LLP

(57) ABSTRACT

A twist-on connector for electrical wires has a shell of insulating material and a metal coil inserted into an aperture in the shell. The aperture extending from one end of the shell and has an outer tapered section which is threaded to engage the electrical wires. A beveled section of the aperture extends inwardly from the outer tapered section to an intermediate tapered section. The intermediate tapered section is formed by a threadless region which is proximate to the beveled section and a threaded region extending inward from the threadless region. A closed end section of the aperture adjoins the intermediate tapered section. The coil is frusto-conical with several turns at the larger end engaging the threadless region of the aperture and the smaller end engaging the closed end section of the aperture. The middle coil portion is spaced from the shell. Cooperation of the shell aperture sections and the coil enables the coil to be pressed directly into the aperture without having to rotated either component during insertion which was previously required to avoid thread damage.

19 Claims, 3 Drawing Sheets

TWIST-ON WIRE CONNECTOR ADAPTED FOR RAPID ASSEMBLY

BACKGROUND OF THE INVENTION

The present invention relates to twist-on connectors for electrically coupling stripped ends of a plurality of wires; and more particularly to such connectors which have a tapered metal coil within an insulating shell.

The ends of two or more wires for an electrical circuit often are connected together using a twist-on type wire connector. These connectors are available in a variety of sizes and shapes and commonly have a frusto-conical shaped shell of insulating material, such as plastic, with an opening at the larger end. The opening communicates with a similarly tapered aperture that has internal helical threads. The fastening operation is performed by inserting the stripped ends of two or more wires into the open end and rotating the connector so that the threads screw onto and twist the wires to form an electrical coupling. In an improvement of the basic connector, a tapered metal wire coil is inserted into the shell aperture engaging the threads along substantially the entire length of the coil. The conductive coil engages the bare wires and aids in providing a conductive path therebetween.

The shell is molded from plastic and thereafter the tapered metal coil is inserted into the shell aperture. Previously, either the coil or the shell had to be rotated during this insertion so that the coil turns mesh with threads of the shell aperture. Because screwing the components together is a time consuming process, alternative faster assembly techniques are desired. To that purpose, attempts were made to merely press the tapered coil into the conical threaded shell aperture without rotating those components. However, the insertion force stripped the threads of the plastic shell destroying the utility of the threads in retaining the coil in the shell.

SUMMARY OF THE INVENTION

A general object of the present invention is to provide a twist-on wire connector in which the shell and coil are adapted for rapid assembly.

Another object is to provide such a wire connector wherein the coil can be pressed into the shell with minimal damage to threads of the shell aperture.

These and other objectives are satisfied by a twist-on connector that includes a shell of electrically insulating material having a frusto-conical shape with an aperture extending from one end of the shell. The aperture has an outer tapered section adjacent to the one end with threads that engage electrical wires inserted into the aperture for connection. A beveled section of the aperture extends inwardly from the outer tapered section to a smaller diameter intermediate tapered section formed by a threadless region adjacent to the beveled section and a threaded region extending inward from the threadless region. The aperture further includes a closed end section that adjoins the intermediate tapered section.

A coil, within the aperture of the shell, has a frusto-conical shape with a larger end, a smaller end and a middle portion therebetween. The coil has a first plurality of turns at the larger end which engage the threadless region of the aperture. The smaller end engages the closed end section of the aperture with the middle portion being spaced from the shell prior to insertion of electrical wires into the aperture.

As the coil makes minimal contact with the shell prior to insertion of the wires, the coil may be pressed into the shell aperture with negligible damage to the aperture threads.

DETAILED DESCRIPTION OF THE INVENTION

Figure 1:
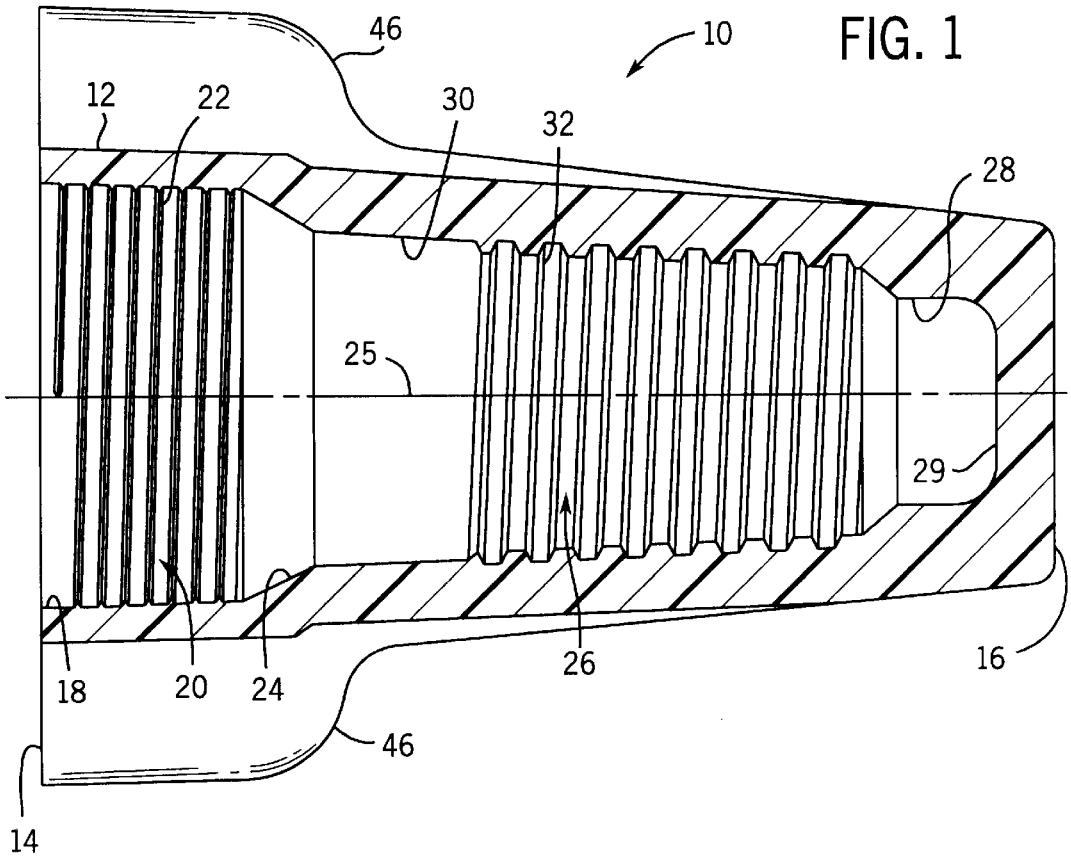
FIG. 1 is a longitudinal cross-sectional view of a shell for a twist-on wire connector according to the present invention.
Figure 2:
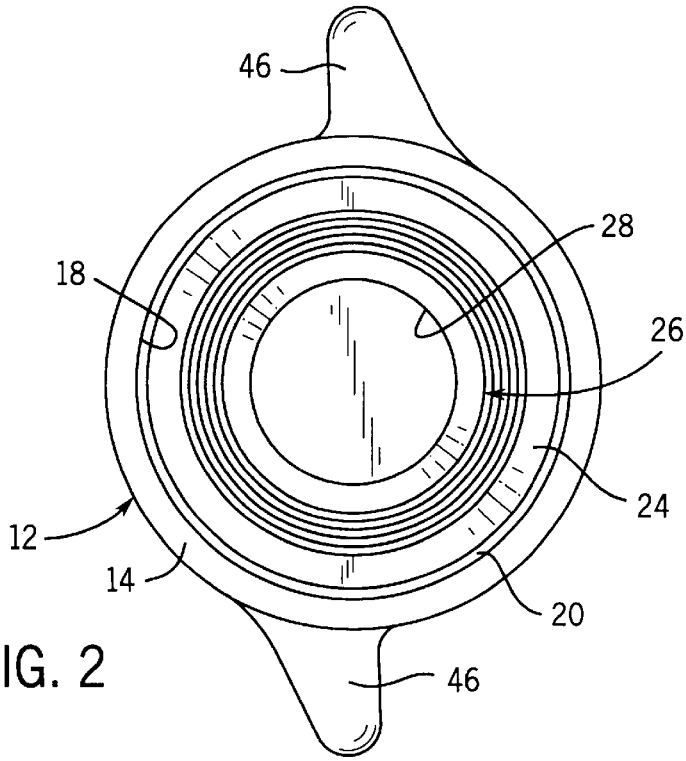
FIG. 2 is a plane view of the open end of the wire connector shell.

Referring initially to FIGS. 1 and 2, a twist-on wire connector 10 is formed of a hollow shell 12 of molded plastic. The shell 12 has the shape of a truncated cone which tapers from an open end 14 to a smaller closed end 16. The open end 14 of the wire connector has a circular aperture 18 extending axially into the shell 12 terminating a short distance from the closed end 16 at an end wall 29. The aperture 18 has an outer tapered section 20 adjacent to the open end 14 with interior threads 22 to engage insulation on the electrical wires (not shown) that become inserted into the aperture for connection.

The gradual taper of the outer tapered section 20 becomes more pronounced (i.e. steeper) at a threadless beveled section 24 of the aperture 18 which is on the interior side of the outer tapered section. Specifically the outer tapered section 20 tapers toward the center axis 25 of the shell 12 at a first acute angle, while the beveled section 24 tapers inward at a larger second acute angle. The beveled section 24 reduces the internal diameter of the shell 12 to an intermediate tapered section 26 comprising the majority of the depth of aperture 18 which terminates in a smaller diameter, threadless closed end section 28. The intermediate tapered section 26 tapers toward the center axis of the shell 12 at a third acute angle that is smaller than the second angle of the bevel section taper. The closed end section 28 perferrably is cylindrical, but it may be tapered.

The intermediate tapered section 26 has a threadless region 30 adjoining the beveled section 24 and a threaded region 32 extending from that threadless region 30 to the closed end section 28 of aperture 18. For example, the outer tapered section 20 is approximately one-quarter of the depth of the aperture 18, the beveled section 24 is approximately one-tenth the aperture depth, the intermediate tapered section 26 is approximately one-half the depth of the aperture 18, and the closed end section 28 makes up the remainder of the aperture. Furthermore the threadless region 30 is approximately one-fifth the depth of intermediate tapered section 26 and the threaded region 32 is four-fifth of that depth.

Figure 3:
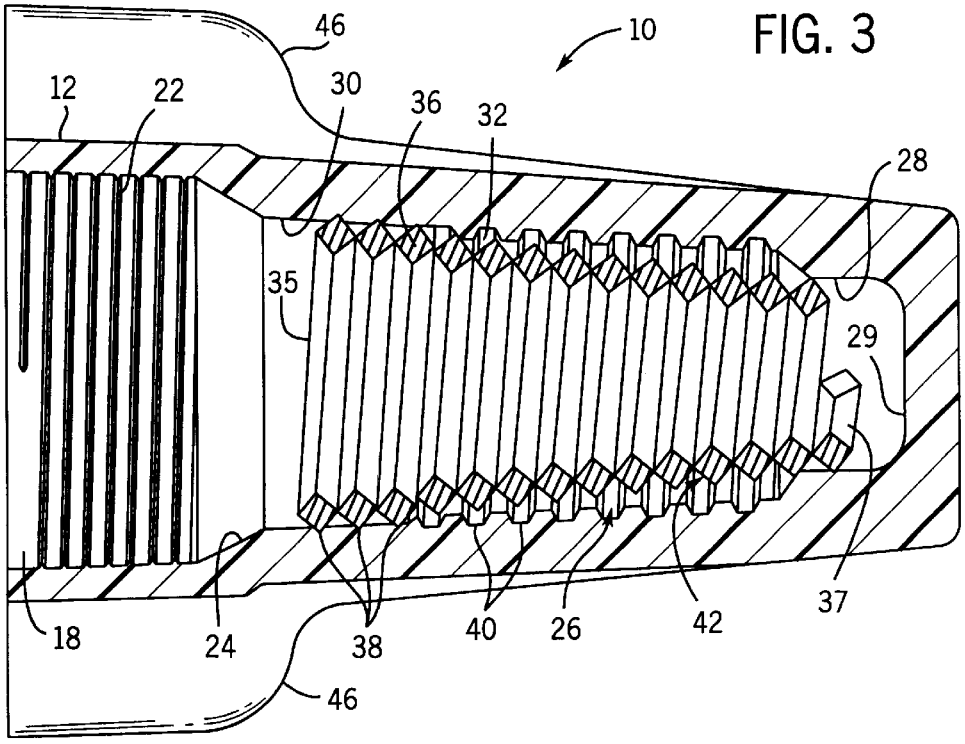
FIG. 3 is a longitudinal cross-sectional view of a twist-on wire connector with a wire coil inserted into the shell.

With reference to FIG. 3, the assembled wire connector further includes a tapered coil 36 of electrically conductive material, such as a metal wire having a square cross section. The tapered coil 36 has a larger end 35 and a smaller end 37. The design of the aperture 18 of the shell 12 in conjunction with the contour of the coil 36, enables the coil to be inserted into the shell without having to rotate one of those components with respect to the other as was the assembly method for prior connectors. Instead the coil 36 is pressed directly into the shell 12 with negligible damage to the threads on the interior surface of the shell.

In the assembled connector 10, a first group of turns 38 (e.g. three turns) at the larger end 35 of the coil 36 engage the threadless region 30 of the shell aperture. The coil 36 is wound with a corner of the square cross-section facing outward and that corner of the first group of turns may bite into the surface of the aperture in the threadless region 30. A second group of coil turns 40 (e.g. one to three turns), which adjoins the first group of turns, engages the threads of the threaded region 32 of the aperture's intermediate tapered section 26. This engagement of the coil with the shell retains those components in an interlocking relationship. However, because the coil 36 has a steeper taper than the intermediate tapered section 26 of the aperture, the second group of coil turns 40 does not fully engage the aperture threads. Note that the outer corner edges of the turns do not contact the bottom of the threads grooves. That steeper coil taper also results in a middle portion 42 of the coil being spaced from the interior shell wall. The coil is more steeply tapered because the apex angle of its frusto-conical shape is larger than the apex angle of the frusto-conical intermediate tapered aperture section 26. The small end 37 of the coil 36 nests inside the threadless closed end section 28 of the aperture. Because the coil 36 upon insertion into the shell has minimal contact with the threads of the aperture 18, the coil 36 to be pressed into the plastic shell 12 without severely damaging the threads, as will be described.

As seen in FIGS. 1 and 2, the wire connector shell 12 also includes a pair of external wings 46 which extend radially adjacent the open end 14. To connect two or more electrical wires, the wires are inserted into the shell aperture at the open end 14. The beveled section 24 directs the wires from the outer tapered section 20 into the smaller diameter intermediate tapered section 26 and the coil 36 therein.

Then the wire connector 10 is turned onto the wires in the same direction as one would turn a nut onto a bolt. This turning is facilitated by the wings 46 which allow the user to grasp the connector shell 12 between a thumb and an index finger. As the connector 10 is turned in this manner the inward facing corner edge of the coil 36 bites into the wires drawing the wires into the connector. The turning also causes the coil 36 to screw farther into the shell 12 until the smaller end of the coil abuts the wall 29 at the closed end section 28 of the shell aperture 18.

Figure 4:
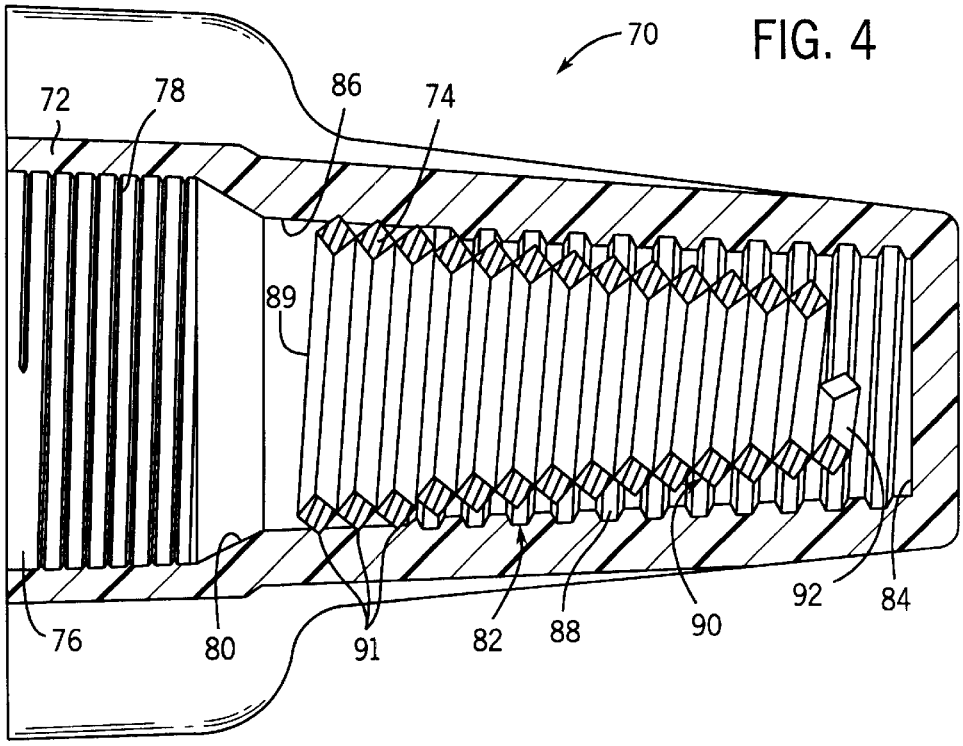
FIG. 4 is a longitudinal cross-sectional view of a second embodiment of a twist-on wire connector showing a wire coil inserted into the shell.

FIG. 4 shows an alternative embodiment of a twist-on wire connector 70 with a hollow shell 72 and a metal coil 74 therein. The shell 72 has a aperture 76 extending into the shell 72 from the larger end and the aperture is similar to the aperture of shell 12 except for the omission of the closed end section 28. Specifically, the aperture 76 in shell 72 has a threaded outer tapered section 78 for engaging insulation on the wires being connected. From the outer tapered section 78, a threadless beveled section 80 abruptly reduces the aperture diameter to an intermediate tapered section 82 which extends to the end wall 84 at the closed end of the aperture 76. The intermediate tapered section 82 is divided into a threadless region 86 adjoining the beveled section 80 and a threaded region 88 extending from that threadless region 86 to the end wall 84.

The tapered coil has a larger end 89 with several turns 91 that engage the threadless region 86 of the intermediate tapered aperture section 82. An additional turn or two engage a few threads of the threaded region 88. Beyond those few threads, the remainder of the coil 74, including the middle portion 90 and a smaller end 92, is spaced from the interior shell wall. Thus the middle portion 90 and a smaller end 92 are suspended in a cantilevered manner within the shell 72.

In this embodiment, only a few threads will be struck by the coil when the coil 74 is pressed into the aperture 76 of the shell 72. Thus the majority of the threads remain untouched by the cloi 74 until the connector 70 is twisted onto wires which causes the coil to expand radially as the wires are drawn farther into the coil.

Figure 5:
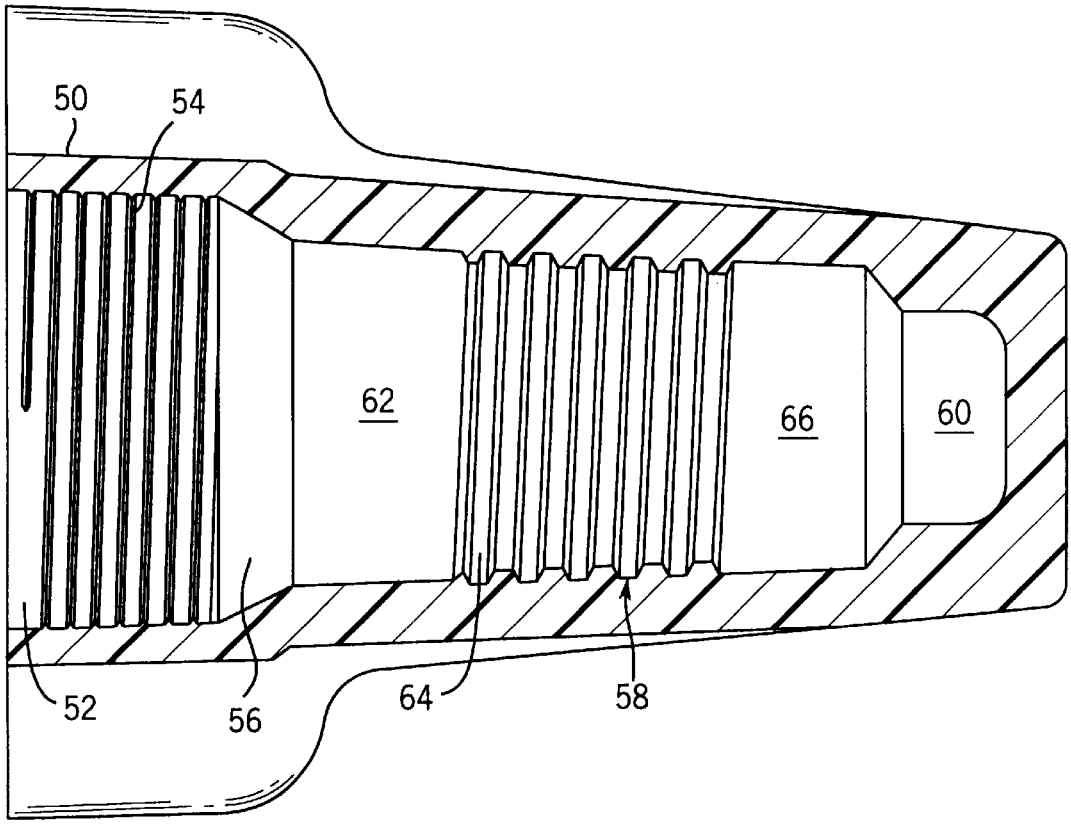
FIG. 5 is a longitudinal cross-sectional view of a third embodiment of a shell for the twist-on wire connector.

FIG. 5 depicts another alternative embodiment of a connector shell 50 according to the present invention. This shell 50 has an exterior shape similar to the previously described shell 12 and has an aperture 52 extending into the shell from the larger end. Going inward, the aperture 52 has a threaded outer tapered section 54, a beveled section 56, intermediate tapered section 58 and a closed end section 60. The intermediate tapered section 58 has a threadless region 62 adjoining the beveled section 56, and a threaded region 64 extending inward from that threadless region 62. Unlike the previous shell 12, the threaded region 64 does not extend all the way to the closed end section 60 of aperture 52. Instead, there is an intervening interior threadless region 66.

The interior threadless region 66 facilitates removal of the mold core from connector shell during injection molding. The shell 50 is formed by injecting molten plastic into the cavity of a mold that has a core that fits into an outer body. The mold core forms the interior surfaces of the shell and an outer body forms exterior surface of the shell. The core and body of the mold are cooled by water flowing through internal passages. This cooling causes the shell to solidify from the outside inward with external skins forming first.

After the shell has partially cooled, the core and the body move apart and the body separates from the shell. The shell remains on the core because the aperture threads interlock with the core elements that formed those threads. Then, the shell is pushed or pulled from the core which must occur after the threads have reached a state of elasticity in which they will return to the desired shape. If the shell is removed from the core too soon the internal shell threads do not return to the desired shape after being smoothed over by the core removal. This removal of the shell from the mold core limits the speed at which the mold can be recycled to make another shell.

The portion of the mold core that forms the closed end of the aperture 52 is too small to accommodate water passages for cooling. Thus the corresponding sections of the shell take longer to cool. However, by removing the threads from aperture region 66, the removal of the shell from the mold core can occur sooner as the process does not have to wait until those innermost threads have cooled to the proper state of elasticity to withstand core removal.

What is claimed is:

1. A twist-on connector for joining ends of electrical wires, said twist-on connector comprising:

a shell of electrically insulating material having a frusto-conical shape with an aperture extending from one end of the shell to closed end, the aperture has an outer tapered section proximate to the one end and which is threaded to engage the electrical wires, a beveled section of the aperture tapers inwardly from the outer tapered section to an intermediate tapered section, the intermediate tapered section being formed by a threadless region proximate to the beveled section and a threaded region extending inward from the threadless region toward the closed end; and a coil within the aperture of the shell and having a conical shape with a larger end, a smaller end and a middle portion therebetween, the coil having a first plurality of turns at the larger end which engage the threadless region of the aperture, and the middle portion being spaced from the shell prior to insertion of the electrical wires into the aperture.

2. The twist-on connector as recited in claim 1 wherein the coil is formed of electrically conductive material.

3. The twist-on connector as recited in claim 1 wherein the coil has at least one turn adjoining the first plurality of turns and engaging the threaded region of the intermediate tapered section of the aperture in the shell.

4. The twist-on connector as recited in claim 1 wherein the coil has a second plurality of turns adjoining the first plurality of turns and engaging the threaded region of the intermediate tapered section of the aperture in the shell.

5. The twist-on connector as recited in claim 1 wherein the intermediate tapered section has an interior threadless region between the threaded region and the closed end.

6. The twist-on connector as recited in claim 1 wherein the aperture has a depth and the outer tapered section extends for substantially one-quarter of the depth, the beveled section extends for substantially one-tenth the depth, and the intermediate tapered section extends for at least substantially one-half the depth of the aperture.

7. The twist-on connector as recited in claim 6 wherein the intermediate tapered section has a given depth and the threadless region is approximately one-fifth the given depth.

8. The twist-on connector as recited in claim 1 wherein the aperture further has a closed end section that between the intermediate tapered section and the closed end; and the smaller end of the coil engages the closed end section.

9. The twist-on connector as recited in claim 8 wherein the closed end section of the aperture is cylindrical.

10. The twist-on connector as recited in claim 1 wherein the outer tapered section tapers toward a center axis of the shell at a first acute angle; the beveled section tapers toward the center axis of the shell at a larger second acute angle; and the intermediate tapered section tapers toward the center axis of the shell at a third acute angle that is smaller than the second angle.

11. A twist-on connector for joining ends of electrical wires, said twist-on connector comprising:

a shell of electrically insulating material having a frusto-conical shape with an aperture extending from one end of the shell, the aperture has an outer tapered section proximate to the one end and which is threaded to engage the electrical wires, an intermediate tapered section of the aperture extends inwardly from the outer tapered section, the intermediate tapered section is formed by a threadless region proximate to the outer tapered section and a threaded region extending inward from the threadless region, and the aperture further having a closed end section that adjoins the intermediate tapered section; and a coil within the aperture of the shell and having a conical shape with a larger end, a smaller end and a middle portion therebetween, the coil having a first plurality of turns at the larger-end which engage the threadless region of the aperture and the smaller end engaging the closed end section of the aperture, and the middle portion being spaced from the shell prior to insertion of the electrical wires into the aperture.

12. The twist-on connector as recited in claim 11 wherein the coil has at least one turn adjoining the first plurality of turns and engaging the threaded region of the intermediate tapered section of the aperture in the shell.

13. The twist-on connector as recited in claim 11 wherein the intermediate tapered section has an interior threadless region between the threaded region and the closed end section.

14. The twist-on connector as recited in claim 11 wherein the aperture has an threadless beveled section between the outer tapered section and the intermediate tapered section.

15. The twist-on connector as recited in claim 11 wherein the aperture has a beveled section between the outer tapered section and the intermediate tapered section.

16. The twist-on connector as recited in claim 15 wherein the outer tapered section tapers toward a center axis of the shell at a first acute angle; the beveled section tapers toward the center axis of the shell at a larger second acute angle; and the intermediate tapered section tapers toward the center axis of the shell at a third acute angle that is smaller than the second angle.

17. The twist-on connector as recited in claim 16 wherein the closed end section of the aperture is cylindrical.

18. The twist-on connector as recited in claim 15 wherein the aperture has a depth and the outer tapered section extends for substantially one-quarter of the depth, the beveled section extends for substantially one-tenth the depth, and the intermediate tapered section extends for substantially one-half the depth of the aperture.

19. The twist-on connector as recited in claim 11 wherein the intermediate tapered section has a given depth and the threadless region is approximately one-fifth the given depth.

* * * * *

UNITED STATES PATENT AND TRADEMARK OFFICE

CERTIFICATE OF CORRECTION

PATENT NO. : 6,414,243 B1
APPLICATION NO. : 08/884049
DATED : July 2, 2002
INVENTOR(S) : Kroinek et al.

It is certified that error appears in the above-identified patent and that said Letters Patent is hereby corrected as shown below:

On the title page,
Item [*] delete "0" and insert --582--.

Signed and Sealed this

Fifth Day of December, 2006

JON W. DUDAS
*Director of the United States Patent and Trademark Office*